US005566509A

United States Patent [19]

Long

[11] Patent Number: 5,566,509

[45] Date of Patent: Oct. 22, 1996

[54] DOOR JAMB REINFORCEMENT STRIP

[76] Inventor: Larry L. Long, 8826 Oak St., Riverview, Fla. 33569

[21] Appl. No.: 514,682

[22] Filed: Aug. 14, 1995

Related U.S. Application Data

[63] Continuation-in-part of Ser. No. 139,013, Oct. 21, 1993, abandoned.

[51] Int. Cl.[6] ..... E06B 1/04

[52] U.S. Cl. ..... 49/462; 49/504; 52/210; 292/340

[58] Field of Search ..... 52/210, 514, 717.01, 52/717.06; 49/460, 462, 504; 292/340, 346

[56] References Cited

U.S. PATENT DOCUMENTS 1,323,755 12/1919 Gogay .
3,918,207 11/1975 Aliotta ..... 49/462
4,057,275 11/1977 LaBeaud ..... 292/340
4,635,399 1/1987 Gehrke et al. ..... 49/460
4,858,384 8/1989 Blankenship ..... 49/460
5,070,650 12/1991 Anderson ..... 49/460

*Primary Examiner*—Robert J. Canfield
*Attorney, Agent, or Firm*—John A. Beehner

[57] ABSTRACT

A reinforced assembly for a door opening includes an elongated reinforcement strip having an L-shaped transverse cross-section of one short leg and one long leg, the long leg for mounting on a door jamb face and the short leg for mounting on a door jamb edge. The short leg has a transverse extent such that upon the reinforcement strip being mounted on a door opening, the transverse extent of the short leg of the reinforcement strip is no greater than the offset distance between the forward edge of the adjacent door casing panel and the door jamb face to which the long leg is mounted. For securing the strip to the door jamb and for receiving the latch of a door, a plurality of spaced openings are formed in the long leg of the reinforcement strip, at least one of the openings being generally rectangular to receive the tongue of a door latch mechanism. The elongated reinforcement strip is adapted to be mounted on a door opening free of modifications to the door jamb, door casing panel and door opening.

8 Claims, 2 Drawing Sheets

DOOR JAMB REINFORCEMENT STRIP

CROSS REFERENCE TO RELATED APPLICATION

This is a continuation-in-part of patent application Ser. No. 08/139,013, filed Oct. 21, 1993, now abandoned.

BACKGROUND OF THE INVENTION

1. Technical Field

This invention relates to reinforcement devices to prevent forced entry into a dwelling and, more particularly, to a reinforced door jamb assembly for a door opening which includes a reinforcement strip having an L-shaped transverse cross-section of one short leg and one long leg, the long leg for mounting on a door jamb face and the short leg for mounting on a door jamb edge, the strip including a plurality of spaced screw and latch openings and the reinforcement strip adapted to be mounted on a door opening without requiring modification to the door opening.

2. Description of the Prior Art

Doors in residences and business places are normally set into a door opening in a wall supported by wooden framework and the opening is lined with a door jamb. The door jamb leaves small tolerances on all sides of the door so it may be easily swung open or shut but provide very little space between the door and the jamb. A door stop ledge is built into the door jamb, and a latch opening is provided to receive the extendible tongue of the latch mechanism that is mounted on the door. Normally the locking mechanism causes the tongue to extend into the latch opening and not be retractable by the door knob, but only by a key from the outside of the door or by a turnable knob on the inside of the door. The latch opening is usually in a metal striker plate having a central opening for the latch tongue and one screw on each side of the opening for attachment to the door jamb. The striker plate is usually only about 3–4 inches long. Forcible entry through such a locked door is not difficult. The screws are usually only ½–¾ inch long and are easily stripped out of the wooden door jamb by one or two strong kicks against the outside of the door at the location of the latch tongue.

It is therefore an object of this invention to provide a reinforcement for the door jamb to make it very difficult to break in a door where such a strip is used. It is another object of the invention to provide an elongated steel reinforcement strip having an L-shaped transverse cross-section with a long leg and a short leg, the long leg including at least one centrally located latch opening and a plurality of screw holes spaced over the length of the strip. A further object of present invention is to provide an elongated reinforcement strip in which the short leg has a transverse extent small enough to permit the reinforcement strip to be mounted over a door jamb without modification of the door jamb or surrounding door features, particularly that the short leg fit on the door jamb edge without overlapping or underlapping the door casing panel. It is also an object of the present invention that the long leg fit on the door jamb face without requiring modification of the door jamb or surrounding door structure. Still other objects will become apparent from the more detailed description which follows.

SUMMARY OF THE INVENTION

This invention relates to a door jamb combined with an elongated reinforcement strip placed face-to-face with the door jamb, the strip having an L-shaped transverse cross-section of one long leg and one short leg, the long leg including a plurality of openings spaced over the entire length of the strip and adapted to seat screws or receive a door latch tongue therein.

The short leg of the strip would have a transverse extent which is no greater than the offset distance between the door jamb face and the forward edge of the door casing panel such that when the long leg of the reinforcement strip is mounted on the door jamb face, the short leg of the reinforcement strip is mounted flush with the door jamb edge and is in contact with or slightly spaced from the forward edge of the door casing.

The invention also contemplates a method of reinforcing a door jamb set into a wooden frame work which comprises the steps of providing the elongated reinforcement strip as previously described and mounting the reinforcement strip on the door jamb face such that the long leg of the reinforcement strip is placed in face-to-face contact with the door jamb face and the short leg of the reinforcement strip in face-to-face contact with the door jamb edge, the short leg of the reinforcement strip then contacting or slightly spaced from the adjacent door casing panel thus enabling the reinforcement strip to be mounted on an unmodified door jamb. Finally, the reinforcement strip is secured on the door jamb with a plurality of long screws, each of the screws extending through one of the spaced openings in the long leg of the reinforcement strip, through the door jamb and into the wall stud thereby securely mounting the reinforcement strip on the door jamb.

The reinforced door jamb assembly of the present invention thus provides a substantial improvement over those devices found in the prior art. Most importantly, because of the transverse extent of the short leg of the reinforcement strip, the reinforcement strip may be quickly and easily mounted on various sized door jambs without requiring routing of the door casing panel to accommodate the reinforcement strip. Furthermore, the use of the reinforced door jamb assembly of the present invention on a door greatly increases the security of the door as it becomes substantially more difficult to force the reinforcement strip from contact with the door jamb due to the long screws extending through the door jamb into the wall stud. Finally, because three or more screws are preferably used in securing the reinforcement strip to the door jamb, the resulting securement mechanism is much more sturdy than the standard two screw latch plate arrangement. Therefore, the present invention provides a substantial improvement over those devices found in the prior art.

DESCRIPTION OF THE PREFERRED EMBODIMENT

The features of this invention are illustrated in the attached drawings, which are referred to in the following description.

Figure 3:
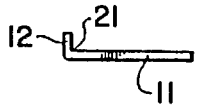
FIG. 3 is a top plan view of the reinforcement strip of this invention.
Figure 1:
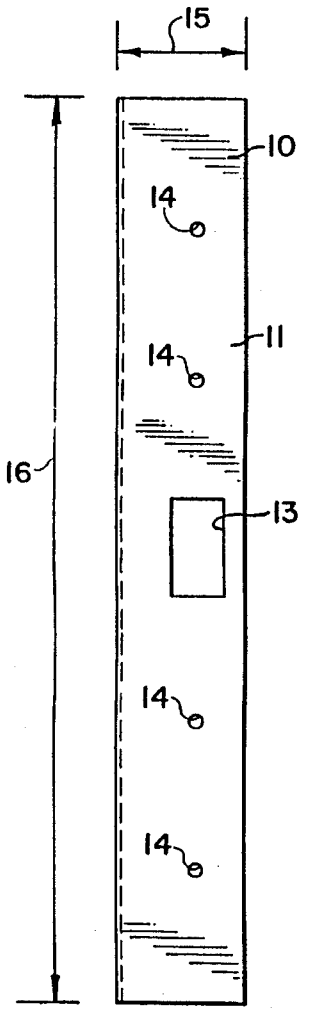
FIG. 1 is a front elevational view of the reinforcement strip of this invention.
Figure 2:
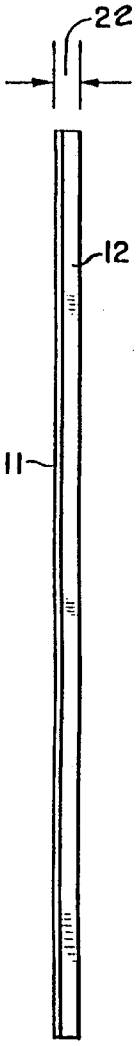
FIG. 2 is a side elevational view of the reinforcement strip of this invention.

The reinforcement strip 10 of this invention is shown in three views in FIGS. 1–3. The strip is an elongated strip of hard, tough material, preferably stainless steel, and it may be preferable to use already angled sections of metal. The reinforcement strip thus has a generally L-shaped transverse cross-section which is the same as the top plan view shown in FIG. 3. The L-shape includes one long leg 11 bent to one short leg 12 at a right angle 21 forming an interior corner that is adapted to fit over an outside vertical corner of a door jamb.

Leg 11 has a centrally located rectangular opening 13 of a size and shape to receive the tongue of the door latch. Strip 10 replaces the short striker plate employed in normal door structures. Opening 13 generally will be about 1.0–2.0 inches in height and about 0.5–1.5 inches in width. Strip 10 is elongated e.g., 18–80 inches long, preferably about 48–72 inches long, and the portions above and below rectangular opening 13 include a plurality of spaced screw holes 14, adapted to receive and guide screws for attaching strip 10 to the supporting door framework. It is preferred that the screw holes 14 be countersunk to accommodate the heads of the screws such that the tops of the screw heads are generally flush with the outer surface of the strip 10.

In normal wooden wall structures, there are two 2×4 vertical studs to which the door jamb is attached, and the screws attaching strip 10 to the door jamb are long enough to pass through the door jamb and into the supporting studs. The screw holes 14 should be spaced above and below rectangular opening 13 to extend from the top end to the bottom end of strip 10. Generally, there will be at least ten screw holes 14 in each strip, the longer the strip the greater the number of screw holes 14. Spacing between adjacent screw holes 14 might be from 4–6 inches.

It is also contemplated that strip 10 could have more than one rectangular opening 13 so as to accommodate additional locking means such as bolts. The positioning of rectangular openings 13 will be made to fit the positioning of bolts or other locking means on the door. It is expected that the reinforcement strip 10 will include a plurality of punched rectangular openings, with only the central rectangular opening being completely punched out. In this manner, the reinforcement strip 10 may be modified for use with a variety of latch and deadbolt arrangements. Screw holes 14 can then be positioned to fit around, and perhaps between, the rectangular openings 13 desired.

The sizes of the various elements of strip 1O can be varied to suit different conditions. The thickness can be 10–20 gauge but 16 gauge is preferred. Rectangular openings may be about 1.0–2.0 inches in height and about 0.5–1.5 inches in width, and other sizes can be used as desired. Screw holes are preferably made for No. 10 screws although this may also vary, e.g., from 8–12. Legs 11 and 12 may also be varied in widths 15 and 22, respectively, as desired. The usual range for width 15 is about 1.0–2.0 inches and the range for width 22 is about 0.25–0.50 inches.

Figure 4:
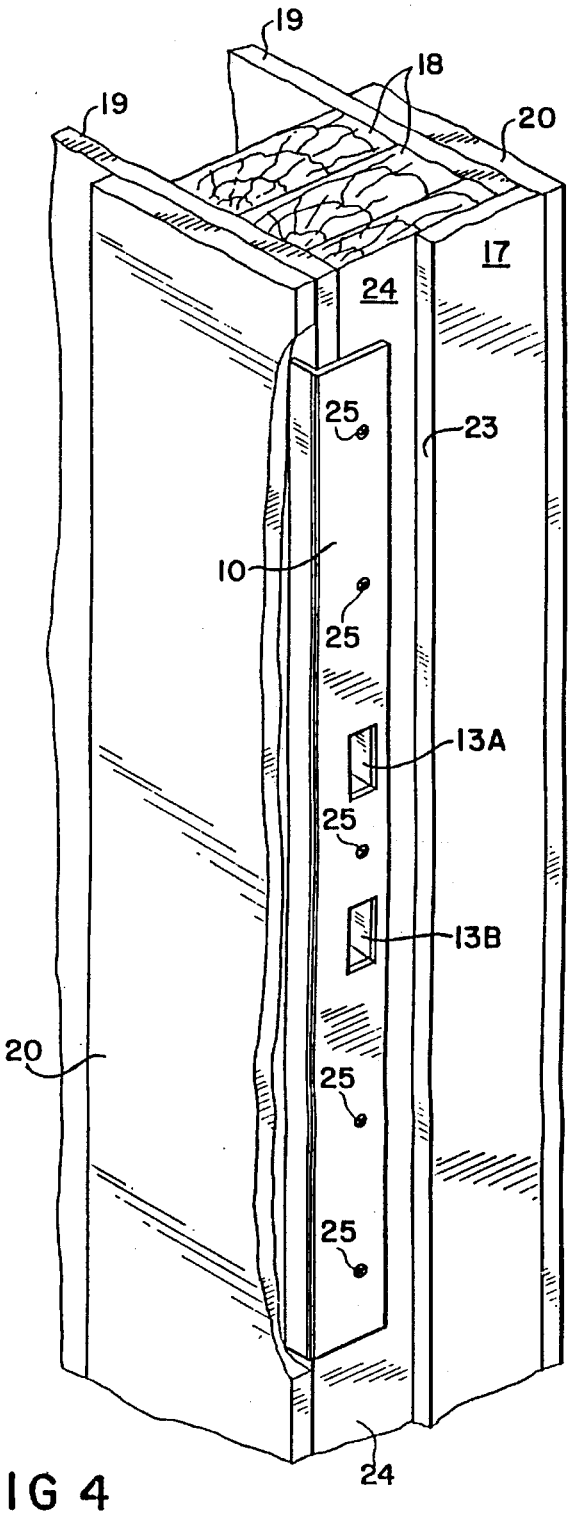
FIG. 4 is a perspective view of a door jamb reinforced by the strip of this invention.

In FIG. 4 there is illustrated one example of how a door jamb may be reinforced according to this invention. In U.S. Pat. No. 5,070,650 there is shown a door frame and door jamb that is reinforced with a two-piece structure of two metal plates that are mounted together on the outside face of a wooden door jamb. In the present invention it has been found that a very strong reinforcement can be provided with a one-piece structure, using only the strip described above and shown in FIGS. 1—3. In FIG. 4, the door framing can be seen to include two vertical studs 18 placed face-to-face to form a nominal 4×4 beam. On the outside and inside of studs 18 are pieces of wall board 19 and door casing panels 20 outside of wall board 19. The face of the first stud 18 is covered by door jamb 17 having a door stop ledge 23 and a door jamb face 24. Strip 10 is mounted on top of door jamb face 24, or, alternatively, strip 10 may be mounted flush with door jamb face 24 by routing door jamb 17 to receive strip 10 so as to have the strip's outer face flush with door jamb face 24. Generally there will be enough space between the door and the door jamb for strip 10 (if it is 16 gauge in thickness) to be mounted on door jamb face 24 without any routing required.

Strip 10 in FIG. 4 is shown with two rectangular openings, 13A and 13B, the former being intended to receive a dead bolt and the latter to receive the normal door latch. In addition there are four or five screws 25 in screw holes 14 and at least nine screws in the longer strips. Preferably screws 25 are about 3 inches long so as to engage door jamb 17 and both of studs 18.

Figure 5:
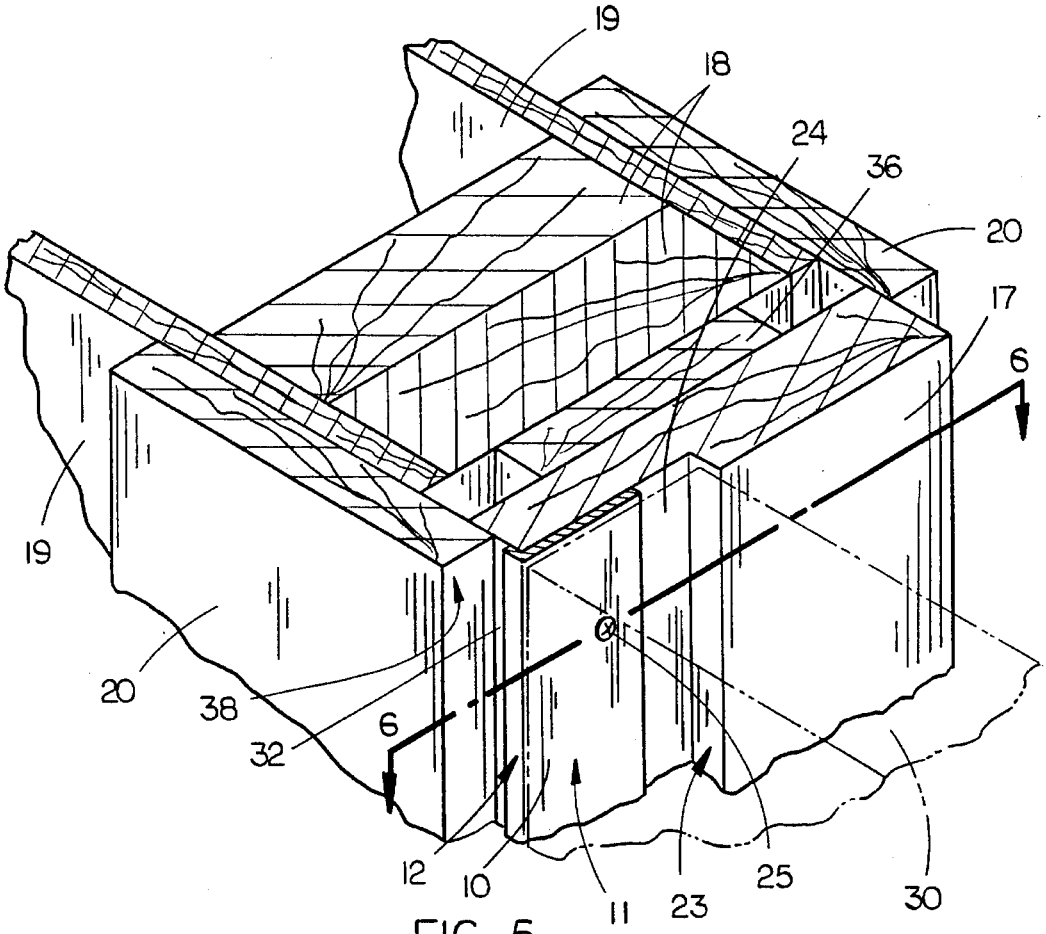
FIG. 5 is a perspective cut-away view of the reinforcement strip of the present invention on a door jamb which shows the arrangement of the various features of the door frame.
Figure 6:
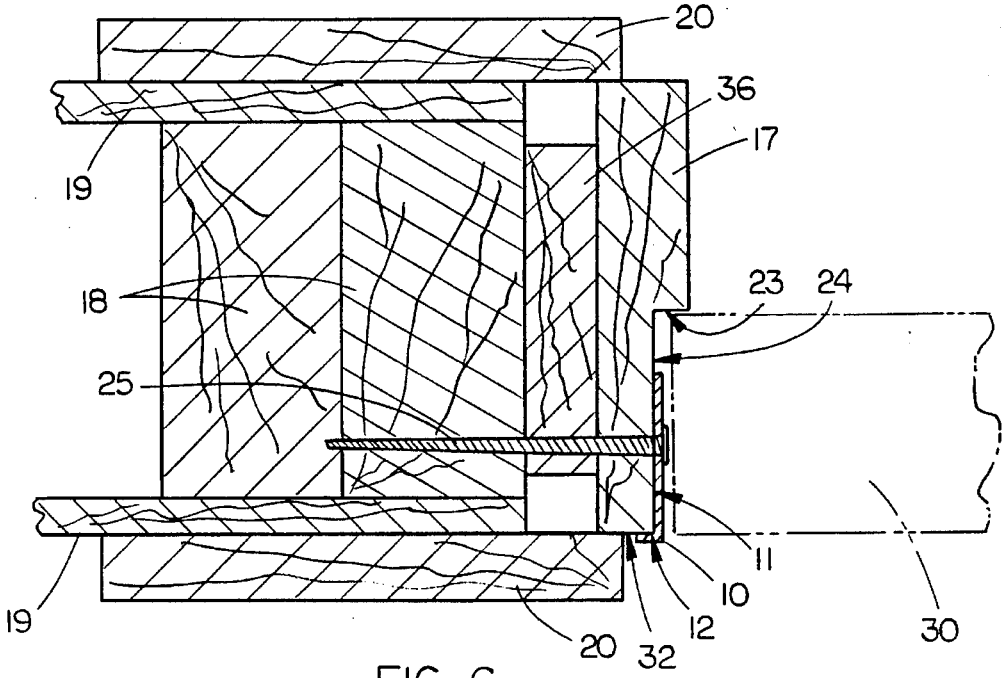
FIG. 6 is a top plan sectional view taken along the line 6—6 of FIG. 5 which shows how the long screws extend through the door jamb and into the wall stud to secure the reinforcement strip on the door jamb.

FIGS. 5 and 6 disclose the preferred embodiment of the reinforcement strip 10 of the present invention. FIGS. 5 and 6 show a standard door frame structure which includes one or more wall studs 18 to which front and rear drywall or wall panels 19 which are affixed to the wall studs 18. The door jamb 17 is affixed the wall studs 18 by nails, screws or the like and the door structure also includes a spacer 36 which properly aligns the door jamb 17 for use with the door 30. As can be seen, reinforcement strip 10 is mounted on the door jamb face 24 of door jamb 17 such that the long leg 11 of reinforcement strip 10 is in face-to-face contact with door jamb face 24. When the reinforcement strip is properly positioned on door jamb face 24, short leg 12 of reinforcement strip 10 should be in face-to-face contact with door jamb edge 32, as shown in FIGS. 5 and 6. The reinforcement strip 10 then may be secured to the door jamb 17 by a plurality of long wood screws 25 which extend through door jamb 17, through spacer 36 and into wall stud 18, thus securely fastening reinforcement strip 10 to the door frame structure.

One important feature of the reinforcement strip 10, as shown in FIGS. 5 and 6, is that short leg 12 has a small enough transverse extent to not require routing of the door casing panel 20 in order to mount the reinforcement strip 10 on the door jamb 17. It is to be understood that the term "transverse extent" refers to the distance of width 22 of short leg 12 minus the thickness of long leg 11. The reinforcement strip 10 may thus be quickly and easily mounted on a variety of door jambs and door frame structures without requiring modification of that structure. Major benefits of this feature include that the reinforcement could be used in apartment or condominium situations where the property is merely being rented and modification of door structures must be kept to a minimum. It is important to note that discussion of modifications to the door casing panel, door opening and door jamb does not include such activities as insertion of screws 25 into the door jamb to secure reinforcement strip 10 on door jamb 17, but instead refers to such changes as routing, cutting, removal and/or replacement of those door frame features.

FIG. 6 also shows that the screw head of screw 25 fits within the countersunk screw hole 14 of strip 10 and thus only a small portion of the screw head of screw 25 remains above the reinforcement strip 10, as shown in FIG. 6. Therefore, the screw head of screw 25 will not interfere with movement of door 30.

It is ultimately preferable that short leg 12 of reinforcement strip 10 have a transverse extent equal to the offset distance between the forward edge 38 of door casing panel 20 and door jamb face 24 such that the edge of short leg 12 abuts the forward edge 38 of door casing panel 20. This offset distance is commonly in the range of 0.25 to 0.75 inches. The ability of a burglar to pry the reinforcement strip 10 away from door jamb 17 is thus greatly lessen, as the burglar or intruder cannot extend a prying device underneath short leg 12 of reinforcement strip 10, of course, so long as short leg 12 is flush with door jamb edge 32, it is somewhat difficult for an intruder to pry reinforcement strip 10 away from door jamb 17.

The reinforcing strip of this invention may also be employed with metal walls and metal doors with appropriate changes to fit the arrangement, e.g., machine screws to attach to the framework of the door.

While the invention has been described with respect to certain specific embodiments, it will be appreciated that many modifications and changes may be made by those skilled in the art without department from the spirit of the invention. It is intended, therefore, by the appended claims to cover all such modifications and changes as fall within the true spirit and scope of the invention.

There has thus been set forth and described a door reinforcement device which accomplishes at least all of the stated objectives.

I claim:

1. In combination, a door opening including a wall stud framing said door opening in a wall having at least one wall panel and at least one door casing panel having a forward edge, a vertical door jamb covering said stud and having a face opposite said wall stud and partially defining said door opening and a door jamb edge perpendicular to said door jamb face and underlapping said at least one door casing panel thereby forming an offset distance between said door jamb face and said forward edge of said at least one door casing panel, a reinforced door jamb assembly comprising;

an elongated reinforcement strip having an L-shaped transverse cross-section and having a length extending substantially the length of said vertical door jamb, said strip comprised of one short leg and one long leg, said long leg mounted on said door jamb face and said short leg being in flush engagement with said door jamb edge and having a transverse extent such that upon said reinforcement strip being mounted on a door opening, said transverse extent of said short leg of said reinforcement strip is no greater than said offset distance;

a plurality of spaced openings formed in said long leg of said reinforcement strip;

at least one of said spaced openings being generally rectangular and adapted to receive a tongue of a door latch mechanism in a door and wherein at least one of said plurality of spaced openings is above said rectangular opening and wherein another of said spaced openings is below said rectangular opening; and said elongated reinforcement strip adapted to be mounted on said door opening generally free of modifications to said door casing panel, said door jamb and said door opening.

2. The combination of claim 1 where said rectangular opening is positioned generally midway of the length of said strip and the remaining openings are generally circular and are spacedly positioned over the entire length of said strip.

3. The combination of claim 1 having two spaced rectangular openings.

4. The combination of claim 1 wherein said strip is attached to said door jamb and the underlying wall stud by at least three wood screws.

5. The combination of claim 1 wherein said strip is made of steel having a thickness of about 10–20 gauge.

6. The combination of claim 1 wherein said strip is 18–80 inches long.

7. The combination of claim 1 wherein said strip further comprises a second generally rectangular opening spaced from said rectangular opening and approximately 1–18 inches apart therefrom.

8. A method of reinforcing a door jamb set into a wooden framework including a wall stud framing a door opening in a wall having at least one wall panel and at least one door casing panel having a forward edge, a vertical door jamb covering the stud and having a door jamb face spaced away from and parallel to the edge of a door and a door jamb edge perpendicular to the door jamb face, the door jamb edge underlapping a door casing panel to provide an offset distance between said door jamb face and said forward edge of said door casing panel, the method comprising the steps:

providing an elongated reinforcement strip having an L-shaped transverse cross-section with one short leg and one long leg including a plurality of spaced openings for reception and retention of screws and a latch, the transverse extent of said short leg from said long leg being no greater than said offset distance;

mounting said reinforcement strip on said door jamb face such that said long leg of said reinforcement strip is placed in face-to-face contact with said door jamb face and said short leg of said reinforcement strip in face-to-face contact with said door jamb edge, wherein said mounting is generally free of modification to said door casing panel, said door jamb and said door opening; and securing said reinforcement strip on said door jamb with a plurality of long screws, each of said screws extending through one of said spaced openings in said long leg, through said door jamb and into said wall stud thereby securely mounting said reinforcement strip on said door jamb.

* * * * *